US005555850A

United States Patent [19]

Garcia

[11] Patent Number: 5,555,850

[45] Date of Patent: Sep. 17, 1996

[54] METHOD AND APPARATUS FOR HEATING LIQUID

[75] Inventor: Kevin M. Garcia, Clovis, Calif.

[73] Assignee: Morris F. Garcia, Clovis, Calif.

[21] Appl. No.: 242,128

[22] Filed: May 13, 1994

[51] Int. Cl.[6] ..... F22B 37/10

[52] U.S. Cl. ..... 122/248; 237/8 A

[58] Field of Search ..... 122/248, 245, 122/247, 250 R; 237/8 R, 8 A

[56] References Cited

U.S. PATENT DOCUMENTS

| | | | |
|---|---|---|---|
| 735,563 | 8/1903 | Myers . | |
| 3,529,579 | 9/1970 | Wanson | 122/248 |
| 3,890,936 | 6/1975 | McInerney et al. | 122/248 |
| 3,962,999 | 6/1976 | Rehm | 122/248 |
| 4,357,910 | 11/1982 | Blockley et al. | 122/248 |
| 4,422,299 | 12/1983 | Sorensen | 122/250 R X |
| 4,938,204 | 7/1990 | Adams . | |
| 5,197,415 | 3/1993 | Stretch et al. . | |

*Primary Examiner*—Henry A. Bennett
*Assistant Examiner*—Susanne C. Tinker
*Attorney, Agent, or Firm*—Worrel & Worrel

[57] ABSTRACT

A method for heating liquid including the steps of pressurizing the liquid; and heating the liquid while under pressure. An apparatus for heating liquid including a conduit system for transporting a liquid to be heated; an assembly for applying heat to the conduit system to heat the liquid in the conduit system; and an assembly for pressurizing the liquid during transporting substantially to prevent conversion of the liquid to vapor.

13 Claims, 4 Drawing Sheets

METHOD AND APPARATUS FOR HEATING LIQUID

BACKGROUND OF THE INVENTION

1. Field of the Invention

The present invention relates to a method and apparatus for heating liquid and, more particularly, to such a method and apparatus which are operable to heat liquids, such as water and the like, more effectively and with greater versatility than has heretofore been possible.

2. Description of the Prior Art

The prior art is replete with devices for heating liquids for a multiplicity of uses. These devices include boilers, water heaters, heat exchangers, heat systems and a wide variety of other types of systems adapted for the same or similar purposes. Such prior art devices can variously be characterized as to their similarities and dissimilarities. However, all such prior art devices known to the applicant intentionally, or as a necessary consequence, produce a vapor phase of the liquid, such as steam in the case of water, or are susceptible to its formation at some point during the operation thereof. For example, steam heating systems have long been employed in both public buildings and private dwellings to render such structures habitable. Similarly, steam has been used as the source of energy for a variety types of equipment including industrial and agricultural machinery, locomotives, automobiles and the like.

It is known that the formation of such vapor produces several undesirable side effects in such devices. For example, the conversion of water into steam causes impurities within the water to precipitate and, over time, to form deposits on internal surfaces. Such deposits ultimately interfere with the operation and effective functioning of such equipment. Valves, pumps and the like malfunction requiring cleaning, repair or replacement. Furthermore, such deposits interfere with fluid pressures and ultimately may completely occlude fluid passages. Still further, thermal conductivity may be significantly reduced. Accordingly, the design and maintenance of such equipment takes into account both the retardation of development and the periodic removal of these deposits. Typically, additives are introduced to the water in an effort to inhibit the formation of such deposits. Obstructed components must be disassembled and cleaned or replaced. These remedies have their own undesirable consequences including the expense thereof.

Perhaps a more significant disadvantage in the usage of many types of equipment which produce steam, or other liquid vapor, is the fact that the vapor phase of a liquid is a much less effective thermal conductor than is its liquid state. As a consequence, in those systems where thermal conductivity is a desired result, once the liquid changes phase to vapor the system operates much less efficiently than prior thereto.

A still further disadvantage of conventional liquid heating systems is their lack of versatility. Conventionally, such systems, once designed, are not adapted to any significant adjustment or modification, either as to the quantities or temperatures produced, or as to the usages to which the end product can be directed. It is well known, for example, that manufacturing plants, office buildings, hospitals, hotels, laundries, apartment complexes and even private dwellings require heated water in a variety of conditions and that these requirements may vary over time. Thus, heated water may be required in two or more different temperatures and in different volumes for usage at different rates. Conventional systems do not possess the versatility satisfactorily to meet these needs.

Therefore, it has long been known that it would be desirable to have a method and apparatus for heating liquid which operate substantially more effectively to produce heated liquid in accordance with the precise requirements of the area of application; which operate significantly more efficiently than has heretofore been possible with prior art devices; which avoid the disadvantages associated with the production of the vapor phase of the liquid; which substantially preclude the development of deposits which, over time, interfere with operation of conventional systems; which possess a versatility not previously available in prior art devices directed to the same purpose; and which are otherwise entirely effective in achieving their operational objectives.

SUMMARY OF TIE INVENTION

Therefore, it is an object of the present invention to provide an improved method and apparatus for heating liquid.

Another object is to provide such a method and apparatus which are particularly well suited to the production of heated liquid without the disadvantages occasioned by the usage of prior art devices.

Another object is to provide such a method and apparatus which possess significantly improved efficiency of operation as compared with prior art systems directed to the same or similar purposes.

Another object is to provide such a method and apparatus which substantially avoid the production of the vapor phase of the liquid, such as steam, during operation thereof.

Another object is to provide such a method and apparatus which permit the usage of liquids, such as water, without the necessity for the introduction of additives to the liquid for the purpose of preventing or inhibiting the formation of sediments or other deposits.

Another object is to provide such a method and apparatus which do not require periodic cleaning of deposits from the system.

Another object is to provide such a method and apparatus which possess a versatility of operation both in the quantities and temperatures of the liquids produced, as well as in the heated liquids available for a plurality of usages.

Further objects and advantages are to provide improved elements and arrangements thereof in an apparatus for the purpose described which is dependable, economical, durable and fully effective in accomplishing its intended purpose.

DESCRIPTION OF THE PREFERRED EMBODIMENT

Figure 2:
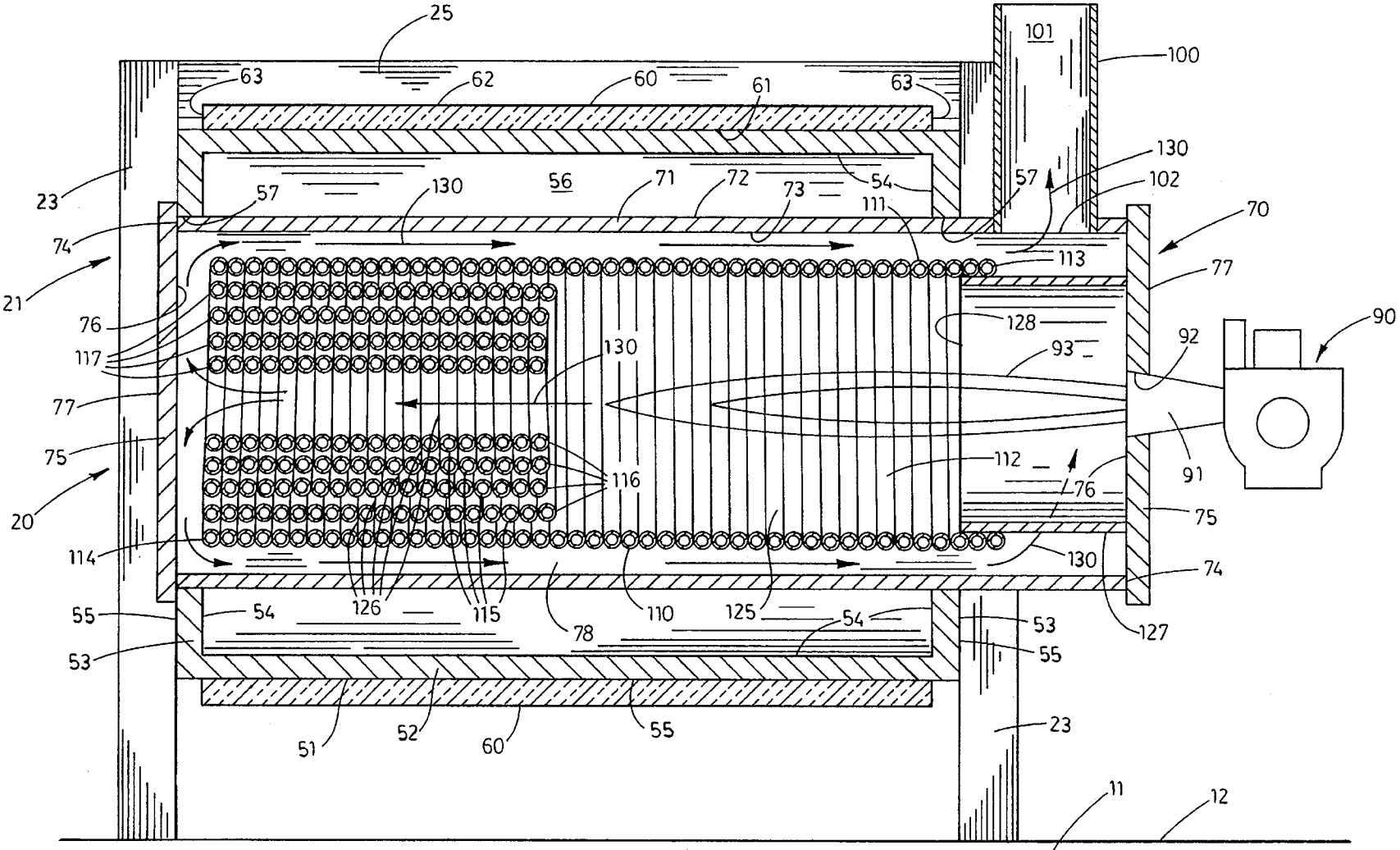
FIG. 2 is a somewhat enlarged, longitudinal vertical section taken from a position indicated by line 2—2 in FIG. 1.
Figure 3:
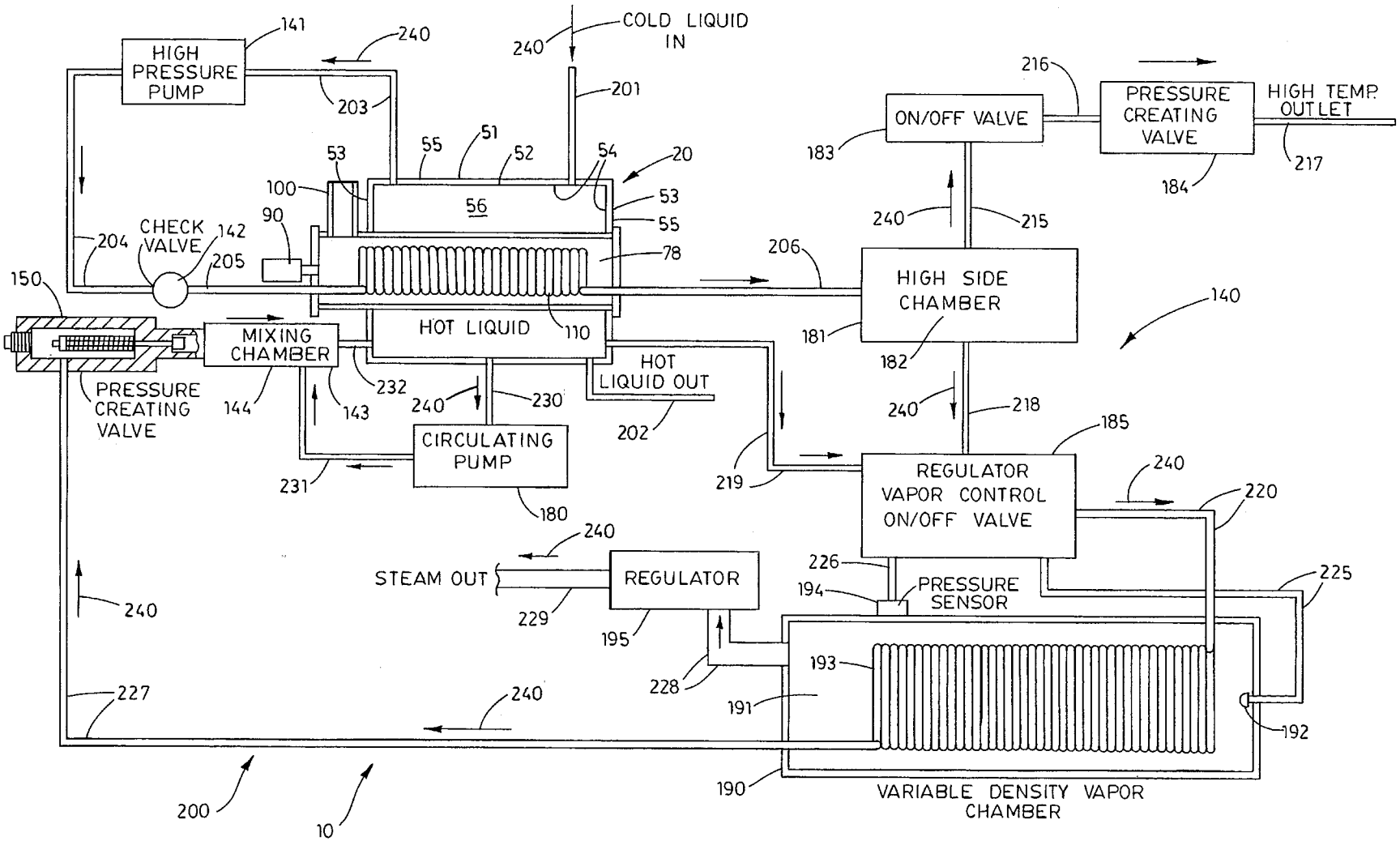
FIG. 3 is a schematic diagram of the apparatus of the present invention operable in the practice of the method of the present invention.

Referring more particularly to the drawings, the heating apparatus of the present invention operable in the practice of the method of the present invention is generally indicated by the numeral 10 in FIG. 3. Although the embodiment shown and described herein is the preferred embodiment, the heating apparatus can be employed in a wide variety of embodiments individually suited to a wide variety of individual operative environments. The operative environment shown and described herein is employed for illustrative convenience. Thus, the heating apparatus 10 is shown in FIG. 2 mounted on a base or concrete floor 11 having a support surface 12.

Figure 1:
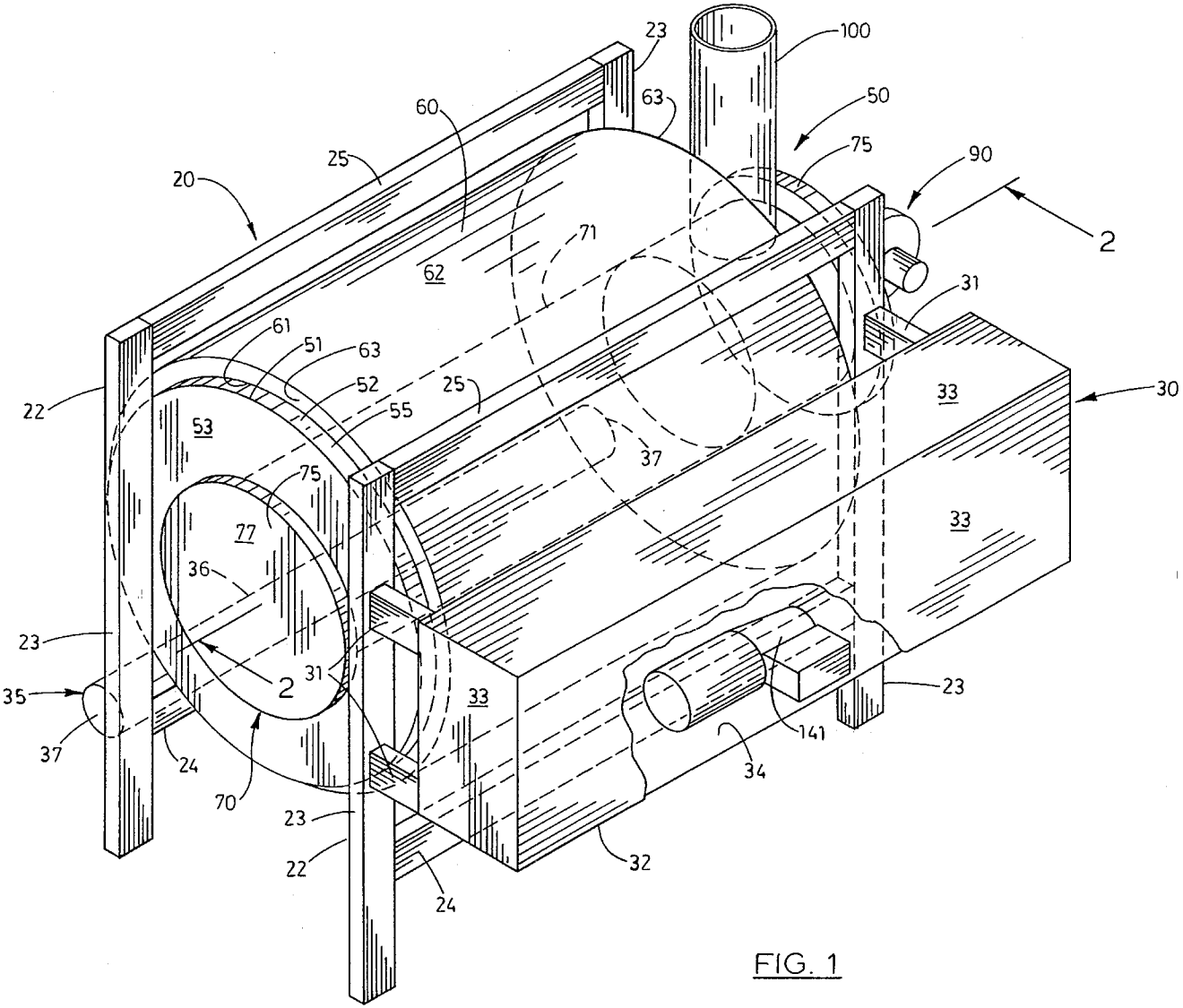
FIG. 1 is a fragmentary perspective view of the primary heating unit of the apparatus of the present invention operable in the practice of the method of the present invention.

The heating apparatus 10 has a primary heating unit 20 which is best shown in FIGS. 1 and 2. The primary heating unit has a main frame 21 composed of a pair of upright subframes 22. Each of the subframes has a pair of upright frame members 23 with the upright frame members of each pair interconnected by a lower horizontal frame member 24 and an upper horizontal frame member 25. The upright frame members of both subframes are preferably mounted on the support surface 12 of the concrete floor 11 by any suitable means, such as bolts or the like.

A primary side housing assembly 30 is mounted on the subframe 22 on the right, as viewed in FIG. 1. More specifically, the primary side housing assembly has a pair of mounting arms 31 mounted on and extending laterally from each of the upright frame members of the subframe on the right, as viewed in FIG. 1. A side housing 32 is mounted on the pairs of mounting arms 31 extending between the pairs in spaced relation to its respective subframe. The side housing is preferably constructed of steel and is preferably of a box like configuration having walls 33 enclosing an interior 34.

A secondary side housing assembly 35 is mounted on the subframe 22 on the left, as viewed in FIG. 1. More specifically, the secondary side housing assembly is preferably mounted on and extends between the upright frame members 23 and can additionally be attached, if desired, to the lower horizontal frame member 24 of the subframe. The secondary side housing assembly has a cylindrical side wall 36 and a pair of opposite end walls 37. The side wall and end walls are also preferably constructed of steel.

The primary heating unit 20 has a heating assembly generally indicated by the numeral 50 in FIG. 1. The heating assembly includes a blanket vessel or main housing 51 constructed of a cylindrical side wall 52 and a pair of end walls 53 individually mounted at the opposite ends of the cylindrical side wall. The side wall and end walls are preferably constructed of thick steel plate. The end walls are preferably mounted on the cylindrical side wall in the described positions in sealing relation thereto. The side wall and end walls of the main housing have interior surfaces 54 and exterior surfaces 55. The main housing is liquid tight and encloses a liquid or heat chamber 56 which is of a cylindrical configuration as defined by the side wall and end walls of the main housing. The end walls have individual annular openings 57 extending therethrough concentric to the cylindrical side wall 52.

An insulation jacket 60, of any suitable material having the desired thermal insulating value, is mounted on the exterior surface 55 of the cylindrical side wall 52 extending entirely thereabout in concentric relation thereto. The insulation jacket has an interior surface 61 disposed in facing engagement with the exterior surface of the cylindrical side wall, and a cylindrical outer surface 62. The insulation jacket has parallel lateral edges 63 extending to the lateral positions shown in FIG. 2.

As shown best in FIG. 2, a heating core 70 is mounted within the main housing 51 concentric to the cylindrical side wall 52 thereof. More specifically, the heating core has a cylindrical side wall 71 which extends through the annular openings 57 of the end walls 53 of the main housing and thus concentrically through the heat chamber 56 of the main housing. The cylindrical side wall 71 has an exterior surface 72 and an opposite interior surface 73. The cylindrical side wall has opposite annular edges 74 on which are individually mounted end plates 75. The end plates are mounted in sealing relation to their respective annular edges 74 by any suitable means. However, preferably, one or both of the end plates are mounted in position by bolts, not shown, so as to be removable for purposes hereinafter described. The end plates individually have interior surfaces 76 and opposite exterior surfaces 77. The heating core has an interior or heat chamber 78 of the cylindrical configuration shown in FIG. 2. The end walls 53 of the main housing 51 are sealed in liquid tight engagement with the exterior surface 72 of the heating core so that the heat chamber 56 thereof is liquid tight.

A burner unit 90 is mounted on the end plate 75 of the heating core 70 on the right, as viewed in FIG. 2. The burner unit can be of any suitable type, but is preferably a conventional turbo burner which uses propane or natural gas as a fuel and which draws ambient air thereinto as an oxidizer to mix with and burn the fuel. The burner unit has a nozzle 91 which extends through and is mounted in an opening 92 of the end plate 75 on the right, as viewed in FIG. 2. As can be visualized therein, the nozzle is concentric to the heat chamber 78 and is operable during operation to direct a flame 93 axially of the heat chamber.

An exhaust conduit or duct 100 is mounted on the cylindrical side wall 71 of the heating core 70 and has a passage 101 communicating with the heat chamber 78 of the heating core through an opening 102. The exhaust duct is preferably upwardly, radially extended from the heating core, as shown in FIG. 2.

A heating coil assembly 110 is mounted in the heat chamber 78 of the heating core 70. The heating coil assembly preferably includes a single continuous coil conduit 111 preferably constructed of steel, or another suitable heat conductive metal. Alternatively, of course, the heating coil assembly can be composed of a plurality of individual coil conduits interconnected in fluid transferring relation. The coil conduit is configured to form an outer cylindrical coil 112 concentric to the heat chamber 78 and extending from a position immediately to the left of the exhaust duct 100, as shown in FIG. 2, to a position in adjacent spaced relation to the interior surface 76 of the end plate 75 on the left, as viewed in FIG. 2. Thus, the outer cylindrical coil has a proximal annulus 113 and an opposite distal annulus 114. The coil conduit 111 is similarly, configured so as to form a plurality of concentric inner cylindrical coils 115 which are inwardly concentric to the outer cylindrical coil 112. The inner cylindrical coils extend from proximal annuli 116 just to the left of the central transverse axis of the heating core 70 to distal annuli 117 disposed in adjacent spaced relation to the interior surface 76 of the end plate 75 on the left, as viewed in FIG. 2. Thus, in the preferred embodiment, the outer cylindrical coil and inner cylindrical coils are formed from the single continuous coil conduit 111.

The area circumscribed by the outer cylindrical coil 112 and extending from its proximal annulus 113 to the proximal annuli 116 of the inner cylindrical coils is sometimes be referred to herein as the central coil heating chamber 125. Similarly, the passages bounded by the outer cylindrical coil and the concentric inner cylindrical coils extending from the proximal annuli 116 to the distal annuli 117 of the inner cylindrical coils will sometimes be referred to herein as concentric coil heating passages 126. A cylindrical wall 127 is mounted on the interior surface 76 of the end plate 75 on the right, as viewed in FIG. 2 and extends in concentric relation to the heat chamber 78 from the end plate 75 to a terminal edge 128 just inwardly of the proximal annulus 113 of the outer cylindrical coil.

For purposes of illustrative convenience, arrows are indicated by the numerals 130 in FIG. 2 indicating the direction of heat flow within the heating core 70 as generated by the burner unit 90. Thus, in operation as will be described, the heat flows through the central coil heating chamber 125 from right to left as viewed in FIG. 2, the concentric coil heating passages 126, outwardly about the distal annulus 114 of the outer cylindrical coil, in the reverse direction about the outer cylindrical coil from left to right as viewed in FIG. 2 and from the heating core 70 through the exhaust duct 100.

Figure 4:
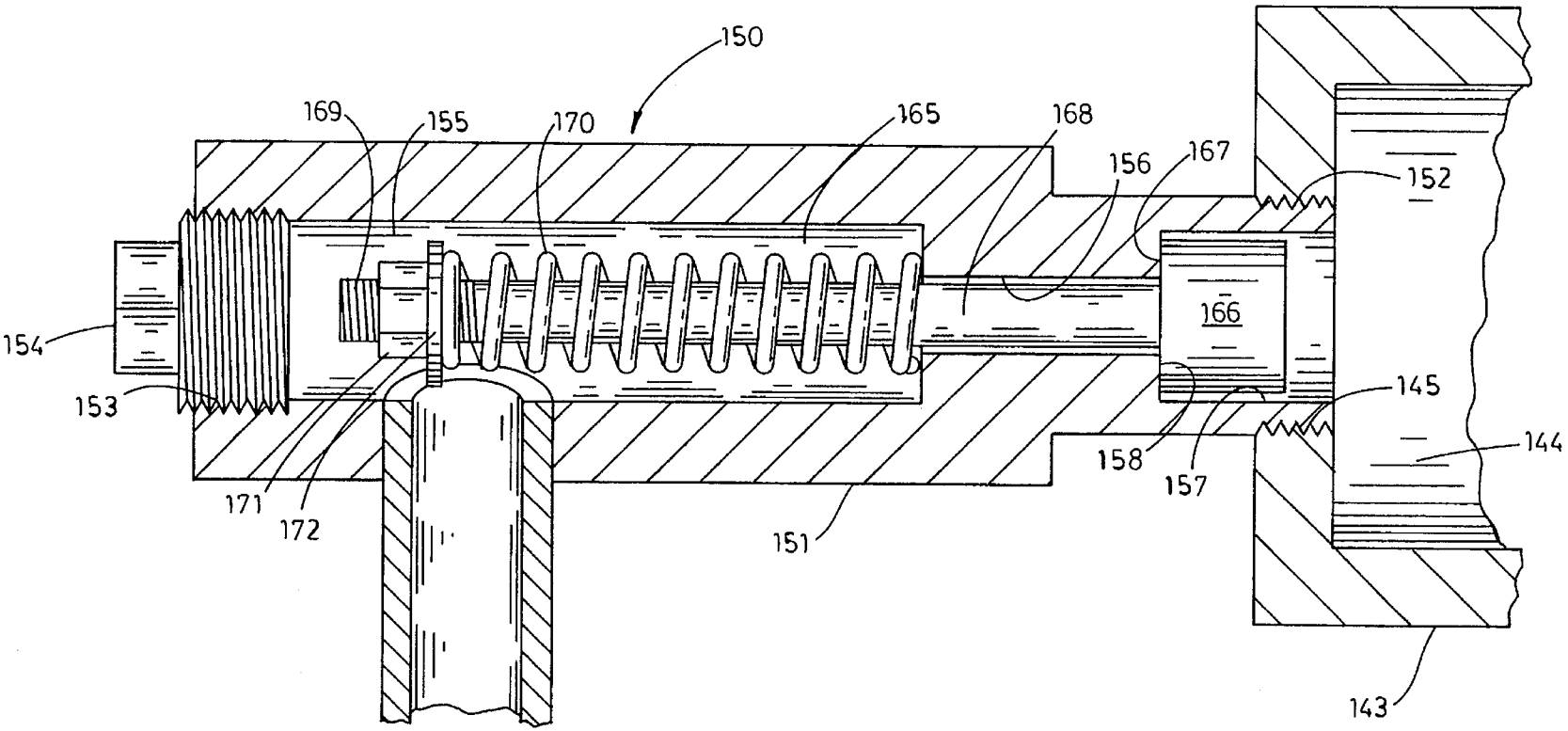
FIG. 4 is a somewhat enlarged, fragmentary longitudinal section of a pressurizing valve of the apparatus of the present invention.

Referring more particularly to FIG. 3, the apparatus 10 of the present invention has a liquid control system generally indicated by the numeral 140. The liquid control system has a high pressure pump 141 which is operable to place liquid under pressure within a substantial portion of the liquid control system. In the preferred embodiment, the high pressure pump together with many of the other subsystems of the apparatus are actually physically mounted in the side housing 32. A check valve 142 is operable to permit liquid movement therethrough from left to right, as viewed in FIG. 3, but not from right to left as viewed therein, for reasons hereinafter to be described. The liquid control system has a mixing vessel 143 having a mixing chamber 144 therewithin sealed in liquid tight relation. As shown in FIG. 4, the mixing vessel has an internally screw threaded bore 145.

A normally closed, pressure creating, or pressurizing valve 150, having a valve body 151 and an externally screw threaded end portion 152, is mounted on the mixing vessel 143 with the externally screw threaded end portion thereof screw-threadably secured in the internally screw threaded bore 145 of the mixing vessel, as shown in FIG. 4. The valve body has an opposite internally screw threaded end portion 153 in which is removably received an externally screw threaded sealing plug 154. The valve body has a cylindrical, primary valve chamber 155 which communicates, as shown in FIG. 4, at the right end thereof with a smaller diameter, axially extended rod passage 156. The rod passage connects at its distal end with a cylindrical, axially extended secondary valve chamber 157 of substantially the same diameter as the primary valve chamber 155. The point of interconnection of the rod passage with the secondary valve chamber is circumscribed by a valve seat 158 defining a plane right-angularly related to the axis of the primary valve chamber, rod passage and secondary valve chamber. The secondary valve chamber extends through the externally screw threaded end portion 152 of the valve body so as to communicate directly with the mixing chamber 144 of the mixing vessel 143.

A valve assembly 165 is mounted within the valve body 151 of the pressurizing valve 150, as shown in FIG. 4. The valve assembly includes a valve member 166 having a cylindrical configuration and thus having a sealing surface 167 facing the valve seat 158. A rod 168 extends axially from the valve member 166 through the rod passage 156 and through the primary valve chamber 155 to a screw threaded end portion 169 adjacent to the sealing plug 154. A compression spring 170 is received about the rod 168 and is held in position with one end thereof in engagement with the valve body and the other end thereof compressed by a securing nut 171 and a washer 172 which directly engages the compression spring, as shown in FIG. 4. Thus, the compression spring retains the sealing surface 167 of the valve member 166 in the normally closed position shown in FIG. 4 in liquid sealing engagement with the valve seat 158. However, the valve assembly, and thus the valve member 166, is operable by liquid pressure to move the valve member to the right, as viewed in FIG. 4, so as to open liquid communication through the rod passage between the primary valve chamber 155 and the secondary valve chamber 157. The force applied by the compression spring in retaining the valve member in the normally closed position is adjusted by tightening or loosening the nut on the screw threaded end portion. The adjustment in the illustrative embodiment is to cause the valve member to open only upon a liquid pressure of four hundred (400) pounds per square inch being applied thereagainst through the rod passage 156. Furthermore, it will be seen that the valve seat 158 faces in a downstream direction which achieves operative benefits to be discussed. It will be understood that the pressurizing valve 150 constitutes not only a novel part of the method and apparatus of the present invention, but also a novel valve in its own right.

The liquid control system 140 has a circulating pump 180 and a storage vessel 181 housing a liquid tight storage chamber 182, which is sometimes referred to herein as the "high side chamber." In one embodiment of the invention, the storage vessel 181 is actually physically located in the secondary side housing assembly 35. As shown in FIG. 3, an on/off valve 183 is disposed in series relation with a pressure creating or pressurizing valve 184 identical to pressurizing valve 150. The control system has a regulator vapor control on/off valve 185 and a variable density vapor vessel 190. The vapor vessel has an internal chamber 191. A nozzle 192 is mounted within the chamber of the vapor vessel in axial alignment therewith. A coil 193 formed by a coiled metal conduit to define a cylindrical configuration, as shown in FIG. 3, is mounted in the chamber 191 of the vapor vessel 190. A pressure sensor 194 is mounted on the exterior of the vapor vessel in sensing relation to the pressure within the chamber 191. The liquid control system has a regulator 195.

The liquid control system 140 has a circuit or conduit system 200. The conduit system includes a liquid conduit 201 connected in receiving relation to a source of a liquid which, in the illustrative embodiment, is water. The liquid conduit 20 is connected at its opposite end to the main housing 51 in fluid supplying relation to the heat chamber 56. A liquid conduit 202 interconnects the heat chamber 56 and a predetermined destination for hot liquid produced in accordance with the method and apparatus of the present invention. The destination can be, for example, an insulated storage tank or the like from which the hot water is made available for use. A liquid conduit 203 interconnects the heat chamber 56 and the high pressure pump 141 in fluid transferring relation. A liquid conduit 204 interconnects the high pressure pump 141 and the check valve 142. A liquid conduit 205 interconnects the check valve 142 and extends through the adjacent end plate 75 of the heating core 70 and is connected at its opposite end with the coil conduit 111 at the proximal annulus 113 of the outer cylindrical coil 112. A liquid conduit 206 interconnects the distal annulus 117 of the inner most inner cylindrical coil 115 of the coil conduit 111 and the storage chamber 182 of the storage vessel 181.

A liquid conduit 215 interconnects the storage chamber 182 of the storage vessel 181 and the on/off valve 183 in liquid transferring relation. A liquid conduit 216 interconnects the on/off valve 183 and the pressurizing valve 184 in liquid transferring relation. A liquid conduit 217 interconnects the pressurizing valve 184 and any desired destination for the liquid transferred therethrough, such as an insulated storage tank. A liquid conduit 218 interconnects the storage chamber 182 of the storage vessel 181 and the regulator vapor control on/off valve 185 in liquid transferring relation. A liquid conduit 220 interconnects the regulator vapor control on/off valve 185 and the coil 193 of the vapor vessel 190 in liquid transferring relation.

A liquid conduit 225 interconnects the regulator vapor control on/off valve 185 and the nozzle 192 within the chamber 191 of the vapor vessel 190 in liquid transferring relation. An electrical conductor 226 interconnects the regulator control on/off valve 185 and the pressure sensor 184 to permit the regulator control on/off valve 185 to monitor the pressure within the chamber 191 through the pressure sensor 184. A liquid conduit 227 interconnects the end of the coil 193 on the left, as viewed in FIG. 3, and the primary valve chamber 155 of the pressurizing valve 150 in liquid transferring relation. A vapor or steam conduit 228 interconnects the chamber 191 of the vapor vessel 190 and the regulator 195 in vapor transferring relation. A vapor or steam conduit 229 interconnects the regulator 195 and a destination for the vapor or steam passed therethrough, such as, for example, in the case of a laundry, steam cleaning equipment.

A liquid conduit 230 interconnects the heat chamber 56 of the main housing 51 of the heating assembly 50 and the circulating pump 180 in liquid transferring relation. A liquid conduit 231 interconnects the circulating pump and the mixing chamber 144 of the mixing vessel 143 in liquid transferring relation. A liquid conduit 232 interconnects the mixing chamber 144 of the mixing vessel 143 and the heat chamber 56 of the main housing 51 in liquid transferring relation.

Continuing to refer to FIG. 3, for illustrative convenience, arrows are identified by the numerals 240 to indicate the direction of liquid flow through the liquid control system 140.

OPERATION

The operation of the apparatus 10 of the present invention in the practice of the method of the present invention is hereinafter described. Referring more particularly to FIG. 3, for illustrative convenience, it will be understood that the method and apparatus are employed in the illustrative embodiment in the heating of water. However, it will be understood that the method and apparatus can be employed in the heating of a wide variety of types of liquids and are not to be limited to the heating of water.

It will be understood that any suitable electric control system, not shown, is employed to control the operations hereinafter described using the method and apparatus of the present invention.

In the illustrative embodiment, the liquid conduit 201 is connected to a source of water, such as a municipal water supply. The pressure of water received from municipal water supplies is typically from forty (40) to eighty (80) pounds per square inch. In the illustrative embodiment, it will be understood that the pressure of the water received in the heat chamber 56 of the main housing 51 through liquid conduit 201 is within this pressure range. Liquid control system 140 is filled with water within this pressure range. The high pressure pump 141 operates continuously to fill liquid control system with water from the source. More specifically, the high pressure pump 141 pumps water from the heat chamber 56, through liquid conduit 203, the high pressure pump, liquid conduit 204, check valve 142, liquid conduit 205, heating coil assembly 110, liquid conduit 206, storage chamber 181, liquid conduit 218, regulator vapor control on/off valve 185, liquid conduit 220, coil 193, liquid conduit 227 and to the normally closed pressurizing valve 150.

The pressurizing valve 150 remains in the closed position shown in FIG. 4 with the sealing surface 167 of the valve member 166 in sealing engagement with the valve seat 158 until a build up of pressure within the liquid control system upstream therefrom reaches a predetermined pressure. Thus, the portion of the liquid control system which is pressurized is along the aforementioned course between the high pressure pump 141 and the pressurizing valve 150. The predetermined pressure set by adjustment of the compression spring 170 is four hundred (400) pounds per square inch and so when this water pressure is reached, the valve member 166 moves from the valve seat 158 to open. Such opening allows water under pressure to pass from the pressurizing valve, through the mixing chamber 144 and liquid conduit 232 back into the heat chamber 56. During operation of the apparatus 10, the pressurizing valve 150 opens and closes under the control of the water pressure and the compression spring 170 to maintain this predetermined water pressure. The high pressure pump 141 similarly operates as needed to maintain this predetermined pressure in cooperation with the pressurizing valve.

Water pressure within the remainder of the liquid control system 140 is approximately that of the municipal water supply, or, in other words, in the range of about forty (40) to eighty (80) pounds per square inch. Thus, this is the water pressure within the heat chamber 56 and liquid conduits 203, 202, 230, 231, 232, 219 and 225. The circulating pump 180 operates to circulate water from the heat chamber 56 at this water pressure to the mixing chamber 144. When the pressurizing valve 150 opens, water is received in the mixing chamber therefrom at a pressure of four hundred (400) pounds per square inch. By mixing with the water received from the circulating pump, all of the water attains the same pressure, or, in other words, in the range of forty (40) to eighty (80) pounds per square inch. Water from the mixing chamber thus passes into the heat chamber 56 at a pressure in the range of approximately forty (40) to eighty (80) pounds per square inch.

Suitable sensors, not shown, of the electric control system detect that the water pressure within the portion of the liquid control system 140 between the high pressure pump 141 and the pressurizing valve 150 has reached a pressure of four hundred (400) pounds per square inch. When this is detected, the electrical control system activates the burner unit 90 to generate the flame 93 shown in FIG. 2. As previously noted, the heat flow created thereby passes within the heating core 70 along the courses indicated by the arrows 130 in FIG. 2. In other words, the heat flow passes through the central coil heating chamber 125, along the concentric coil heating passages 126, in the reverse direction about the exterior of the outer cylindrical coil 112 and subsequently out of the heating core through the passage 101 of the exhaust duct 100. Since the burner unit 90 burns propane or natural gas, the exhaust is substantially free of pollutants. However, if desired, any suitable emission control system can be employed in connection with the exhaust duct.

This operation of the apparatus 10 is continued and the water is continually recirculated through the heating coil assembly 110 and the aforementioned portion of the liquid control system 140 as permitted by the now open pressurizing valve 150. Since the water passing therethrough is pressurized to a pressure of approximately four hundred (400) pounds per square inch, the water does not change phase, or, in other words, convert to steam, in the heating coil assembly, or at any other location within the liquid control system. Since water in its liquid phase is significantly more thermally conductive than in its steam, or vapor phase, heat transfer to the water passing through the heating coil assembly is significantly greater than has heretofore been possible. Indicative of this is the fact that even though the burner unit produces a flame of twenty five hundred degrees (2500°) Fahrenheit, during normal operation the temperature of exhaust gases in the passage 101 of the exhaust duct 100 is typically only about two hundred degrees (200°) Fahrenheit. In other words, the heat transferred to the water is significantly greater than has heretofore been possible and this fact is measurably demonstrated by a corresponding comparatively low temperature of the exhaust gases in the passage 101.

In accordance with the method of the present invention, the water is heated during such recirculation until the temperature of the water passing through the heating coil assembly 110 into the storage chamber 182 reaches a predetermined desired temperature. In the illustrative embodiment, the predetermined temperature of the water reaching the storage chamber is approximately four hundred degrees (400°) Fahrenheit. The desired predetermined temperature can be selected using the electric control system.

It will be seen that since the pressurized water reaching storage chamber 182 comes directly from the heating coil assembly 110, it has the highest temperature of all of the heated water produced by the method and apparatus of the present invention. In contrast, and as will subsequently be explained, the water within the heat chamber 56 of the main housing 51 may typically reach a temperature of approximately two hundred twenty degrees (220°) Fahrenheit. These temperatures and pressures are maintained as heated water is drawn off for usage. This is accomplished, upon water being drawn off for use, by the pressurizing valve 150 closing or partially closing and the high pressure pump 141 continuing to pump water into the liquid control system 140 from the heat chamber 56. As noted, the heat chamber receives water from the municipal source through liquid conduit 201. Similarly, the desired temperatures of the water are maintained by controlled operation of the burner unit 90 by the electrical control system.

The selected temperature of the heated water received in the storage chamber 182 is reached simply by recirculating the water from the heat chamber 56 through the heating coil assembly 110, liquid conduit 206, storage vessel 181, liquid conduit 218, regulator vapor control on/off valve 185, liquid conduit 220, coil 193, liquid conduit 227 pressurizing valve 150, mixing chamber 144 and liquid conduit 232 back into the heat chamber 56. This process is continued until the water received by the storage vessel immediately after passage from the heating coil assembly is the desired temperature of four hundred degrees (400°) Fahrenheit. When this temperature has been reached, the passage of water through the heating coil assembly is typically continued by the electric control system only as necessary to replenish the supply in the storage vessel 181 during usage and to maintain the desired temperature.

The desired temperature of the heated water within the heat chamber 56 of the main housing 51 is, in effect, automatically achieved. The desired temperature of the water within the heat chamber, in the illustrative embodiment, is, as noted, approximately two hundred twenty degrees (220°) Fahrenheit. A single passage of heated water through the heating coil assembly 110 while the burner unit 90 is operating raises the temperature of the water about one hundred fifty degrees (150°) Fahrenheit. Accordingly, when the heated water received in the storage vessel is approximately four hundred degrees (400°) Fahrenheit, the temperature of the water in the heat chamber 56 is approximately two hundred twenty degrees (220°) Fahrenheit to two hundred fifty degrees (250°) Fahrenheit. Any variation in a precise one hundred fifty degree (150°) Fahrenheit differential is attributable to a combination of variables. The heated water which is not drawn by the high pressure pump 141 from the heat chamber 56 through liquid conduit 203 does not pass through the heating coil assembly 110 of the heating core 70. This heated water remains heated in that it is in contact with and adjacent to the exterior surface 72 of the heating core 70 and in that the insulation jacket 60 retains the heat which preserves the temperature of the heated water. All of these factors contribute toward the temperature of the heated water within the heat chamber 56 being maintained at approximately two hundred twenty degrees (220°) Fahrenheit.

Therefore, as a direct result of the method and apparatus of the present invention, the heated water within the heat chamber 56 is maintained at a temperature of approximately two hundred twenty degrees (220°) Fahrenheit while the temperature of the water available from the storage vessel 181 is maintained at a temperature of approximately four hundred degrees (400°) Fahrenheit. Therefore, the user of the method and apparatus has heated water, at a temperature of approximately four hundred degrees (400°) Fahrenheit, available through the liquid conduit 217 and heated water, at a temperature of approximately two hundred twenty degrees (220°) Fahrenheit, available through the liquid conduit 202.

These temperatures of the heated water can otherwise be adjusted to suit the specific needs of the user. Adjustment of the temperature of the highest temperature heated water is achieved by continuing to recirculate the heated water through the liquid control system 140 and by increasing or decreasing the heat generated by the burner unit 90.

The interoperation of the circulating pump 80, mixing chamber 144 and pressurizing valve 150 operate to avoid undue turbulence in returning water to the heat chamber 56 as a result of their pressure and temperature differential. By avoiding such turbulence, the rather considerable noise resulting therefrom is similarly avoided. Thus, water leaving the pressurizing valve 150 is premixed with water from the heating chamber 56 so that it is introduced to the heating chamber with significantly less turbulence.

Water of the highest temperature is obtained from the storage vessel 181 for usage by, of course, turning the on/off valve 183 to the "on" position. The pressurizing valve 184 operates to maintain pressure of the water passing thereal-ong at the preselected pressure of, in the illustrative embodiment, approximately four hundred (400) pounds per square inch. There is, as a result, no loss of pressure upstream in the liquid control system and prior to its being distributed for usage as desired.

While the method and apparatus of the present invention are intended to avoid the vaporization of the liquid within the liquid control system 140 for all of the reasons previously set forth, there are, of course, many environments in which vapor, or steam, is needed for usage. The vapor vessel 190 serves this purpose providing, in the illustrative embodiment, steam on demand at the steam conduit 229. The vapor vessel 190 is operable accurately to provide steam of any density, pressure and temperature accurately and consistently as hereinafter described.

As previously noted, heated water is passed through the coil 193 in a continually recirculating manner. The temperature of the water is, as previously noted in regard to the illustrative embodiment, at approximately four hundred degrees (400°) Fahrenheit. When steam is desired for usage, such as, for example, in a laundry, the regulator vapor control on/off valve 185 is operated to deliver heated water along liquid conduit 225 and to discharge the heated water from the nozzle 192 into the chamber 191 and over the coil 193. The coil is thus saturated by the heated water so that the heated water is immediately vaporized. The steam is held within the chamber 191 until the regulator 195 is operated to release the steam along steam conduit 229 for usage. The pressure sensor 194 operates to register steam pressure within the chamber 191. When the steam pressure falls below a predetermined minimum, the regulator vapor control on/off valve is automatically operated by the electric control system, not shown, to again saturate the coil 193 with heated water from the nozzle 192.

The regulator vapor control valve 185 can draw heated water either from the storage chamber 181 at a temperature of approximately four hundred degrees (400°) Fahrenheit, or from the heat chamber 56 of the main housing at a temperature of approximately two hundred twenty degrees (220°) Fahrenheit, or from both in any volumes desired so as to control the temperature of the heated water released from the nozzle 192 to saturate the core 193. By controlling the amount of injected water, the temperature of the injected water, the temperature of the heated water passing through the coil 193, the pressure inside the chamber 191 and the timing of the release of steam, any steam density, pressure and temperature, can accurately and consistently be attained within the control of the operator.

Where desired the size, or in other words, the capacities of the various portions of the apparatus 10 can be increased, or decreased, in construction to provide the precise production desired. Similarly, two or more of the apparatuses can be linked to increase production as desired.

Therefore, the method and apparatus for heating liquid of the present invention operates substantially more effectively to produce heated liquid in accordance with the precise requirements of the area of application; operates significantly more efficiently as heretofore been possible with prior art devices; avoids the disadvantages of the production of steam during the heating operation; substantially precludes the development of sediments or other deposits which, over time, interfere with operation of the system; possesses a versatility not previously available in prior art devices directed to the same purpose; and is otherwise entirely effective in achieving their operational objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A method for heating liquid comprising the steps of pressurizing the liquid to a pressure sufficient substantially to prevent the conversion of the liquid to vapor when heated;

passing the resulting pressurized liquid along a conduit which is coiled to form a coil within a heating vessel;

applying radiant heat to the coil of the conduit to heat the liquid;

drawing off liquid heated in said applying step; segregating said heated liquid into separate portions for individual usage retaining a first of said portions of the heated liquid for usage as a highest temperature heated liquid; and placing a second of said portions of the heated liquid in a liquid chamber substantially surrounding said heating vessel for heating of said second portion therefrom.

2. The method of claim 1 wherein the liquid pressurized in said pressurizing step is drawn from said liquid chamber.

3. The method of claim 1 including the step of employing said second portion of heated liquid within said liquid chamber for usage as a lower temperature heated liquid.

4. The method of claim 1 including the steps of passing a portion of said first or second portions through a conduit; and releasing a liquid on to said conduit to form vapor for subsequent usage.

5. The method of claim 4 wherein the liquid employed in said releasing step is a portion of said first and/or second portions.

6. The method of claim 5 including the step portion to said releasing step of mixing portions of said first and second portions to form a resultant liquid of the desired temperature.

7. The method of claim 1 wherein the heated liquid is maintained under said pressure until usage.

8. The method of claim 7 wherein said pressure is maintained at substantially about four hundred (400) pounds per square inch.

9. The method of claim 7 wherein said pressure is maintained using a pressurizing valve in a conduit system circulating said liquid therethrough in a direction such as to define upstream and downstream sides in the conduit system relative to the direction of liquid movement therethrough and wherein the pressurizing valve has a valve seat facing said down stream side so as to minimize deposits forming in such a manner as to interfere with sealing of said valve seat.

10. The method of claim 7 wherein said pressure is maintained using a conduit system having a high pressure pump at a downstream point therein and a pressurizing valve at an upstream point therein set to open at said pressure.

11. An apparatus for heating liquid comprising a conduit system for transporting a liquid to be heated including a plurality of substantially cylindrical coils of conduit interconnected in fluid communication and disposed in substantially concentric relation; means for applying heat to said conduit system to heat the liquid in the conduit system and operable to direct radiant heat substantially axially of said coils of conduit in heat transferring relation; means for pressurizing the liquid during said transporting substantially to prevent conversion thereof to vapor; a substantially cylindrical first vessel substantially surrounding said coils of conduit to establish a path for said radiant heat energy in a first direction substantially axially of said coils of conduit and then outwardly about and substantially concentric to the coils of conduit in a second and substantially opposite direction; and a second vessel containing a heat chamber substantially surrounding the first vessel and connected in liquid receiving relation to said conduit system for heating of said liquid and for insulating said first vessel.

12. An apparatus for heating liquid comprising a conduit system for transporting a liquid to be heated including a plurality of substantially cylindrical coils of conduit interconnected in fluid communication and disposed in substantially concentric relation; means for applying heat to said conduit system to heat the liquid in the conduit system and operable to direct radiant heat substantially axially of said coils of conduit in heat transferring relation; means for pressurizing the liquid during said transporting substantially to prevent conversion thereof to vapor; a substantially cylindrical first vessel substantially surrounding said coils of conduit to establish a path for said radiant heat energy in a first direction substantially axially of said coils of conduit and then outwardly about and substantially concentric to the coils of conduit in a second and substantially opposite direction; and a second vessel substantially surrounding the first vessel and connected to said conduit system and having a chamber for receiving a first portion of said heated liquid from the conduit system for usage as a lower temperature heated liquid and a storage vessel connected to said conduit system for receiving a second portion of said heated liquid from the conduit system for usage as a higher temperature heated liquid.

13. An apparatus for heating liquid comprising a conduit system for transporting a liquid to be heated; means for applying heat to said conduit system to heat the liquid in the conduit system; and means for pressurizing the liquid during said transporting substantially to prevent conversion thereof to vapor including a source of said liquid to be heated connected in liquid supplying relation to said conduit system, a pump operable to pump said liquid frown said source into the conduit system and a valve operable to open to permit said liquid to be circulated through the conduit system when the pressure of the liquid has reached substantially a predetermined pressure.

* * * * *